United States Patent [19]

Day et al.

[11] Patent Number: 4,505,591

[45] Date of Patent: Mar. 19, 1985

[54] SOLIDS MIXING WELL STRUCTURE AND METHOD

[75] Inventors: Roger W. Day; Charles N. Grichar, both of Houston, Tex.

[73] Assignee: Geosource Inc., Houston, Tex.

[21] Appl. No.: 451,175

[22] Filed: Dec. 20, 1982

[51] Int. Cl.[3] ..... B01F 15/04

[52] U.S. Cl. ..... 366/134; 366/136; 366/162; 366/183; 366/184

[58] Field of Search ..... 137/896, 897; 366/101, 366/134, 136, 137, 159, 160, 162, 167, 174, 177, 178, 181, 183, 184, 341, 348, 349

[56] References Cited

U.S. PATENT DOCUMENTS 2,685,499 8/1954 Hood ..... 366/137

OTHER PUBLICATIONS

"Hydrofeeding of Solids for Pipelines and Processes", Kamyr, Inc., Glen Falls, New York, Oct. 1980.

Bonin et al., "The Development and Experimetal Evaluation of the Kinetic Extruder—A Novel Coal Feeder", Lockheed Palo Alto Research Laboratory, Jun. 1, 1982.

"Twin-Screw Feed Systems for Coal Reactions", Werner & Pfleiderer Corp. (Undated).

*Primary Examiner*—Robert W. Jenkins

*Assistant Examiner*—Arthur D. Dahlberg

*Attorney, Agent, or Firm*—Arnold, White & Durkee

[57] ABSTRACT

Solids mixing well structure and methods are disclosed for mixing a solid having a first specific gravity with a fluid having a second specific gravity to produce a slurry having an intermediate specific gravity and a resultant pressure greater than atmospheric pressure. The solids can then be transported in the form of a slurry using the resultant pressure. At no time do the solids come in contact with a pump member. The apparatus and methods are particularly suited for transporting coal and solid waste material. No moving parts are required other than a pump to supply fluid pressure. A first cylindrical member receives at its inlet fluid at a pressure greater than atmospheric pressure and delivers the fluid at a first pre-determined pressure to a mixing region. A second structure receives at its inlet solids at atmospheric pressure and delivers the solids at the first pre-determined pressure to the mixing region down stream of the fluid. The fluid and solids, having substantially the same pressure in the mixing region, readily mix. The resulting slurry exits the mixing region and flows through a third structure to a discharge port. The slurry exits the discharge port at a second pre-determined pressure greater than atmospheric pressure, and equal to the pressure the slurry would have had if directly pumped at the horsepower of the pump supplying fluid pressure.

4 Claims, 4 Drawing Figures

SOLIDS MIXING WELL STRUCTURE AND METHOD

BACKGROUND OF THE INVENTION

This invention relates generally to the mixing of materials, and more particularly to a mixing well structure and process for mixing various materials with a fluid.

In numerous industrial applications materials must be fed into a pressurized environment. Such applications include coarse particle slurry transportation pipelines, solids tailings disposal systems, and feeding pulverized coal into pressurized gasification and liquification reactors.

Known prior art systems include moving mechanical parts which come in contact with the solids being transported. Such contact results in wear of the mechanical parts, requiring their periodic replacement. Such known equipment is massive in size, costly to manufacture and repair, and generally operates in a batch rather than a continuous mode.

One known type of prior art device includes a massive rotating valve which periodically delivers discreet batches of solids to a mixing region where the solids are mixed with a fluid, such as compressed air or another gas, or water or another liquid. Another known type of prior art device advances solid materials along a twin-screw extruder to a mixing region. In each such prior art system, a mechanical device in physical contact with the solids is used to transport the solids. Friction developed between the mechanical transporting device, generically referred to hereinafter as a pump, and the solids to be transported, produces wear of pump members. Such wear requires not only costly maintenance, but results in contaminating the transported solids with the material worn-off the pump members.

Thus, there is a need for mixing well structure having no moving mechanical parts, having no pump members in physical contact with the solids being transported, and which is continuous in operation, and relatively inexpensive to manufacture and maintain.

SUMMARY OF THE INVENTION

According to the present invention, mixing well structure is provided for mixing a solid with a fluid. Specifically, the present invention provides a solids mixing well wherein the solids do not come into physical contact with a pumping device, and in which a slurry of solids and fluid is discharged at an outlet in a continuous, substantially homogenous stream.

The apparatus according to the present invention can be installed either above ground, below ground, or partially above and partially below ground. For simplicity, the present invention will be described in terms of a below-ground installation.

According to one aspect of the present invention, a hole is drilled in the ground to a pre-determined depth. Three separate conduits are then installed substantially vertically in the hole. Moist or wetted solids having a high specific gravity are introduced down one conduit; pumped fluid having a low specific gravity is introduced down another conduit. The wetted solids and the fluid each have substantially the same pressure as they are discharged from their respective conduits at the bottom of the hole, where they mix together to form a slurry having an intermediate specific gravity.

The head of the wetted solids column and the head of the fluid column are substantially equal to each other, but greater in magnitude than that of the slurry. The slurry therefore flows upward in the remaining conduit to the surface. The slurry is discharged at the surface at the same pressure it would have had if the slurry had been directly pumped by a pump having a horsepower identical to that of the pump which pumped the fluid into the structure. The solids, however, never come in contact with the pump in the present invention. The present system requires neither isolating tanks nor locking or segregating valves.

According to one aspect of the present invention, the fluid is delivered to an inlet of a first conduit at a pressure greater than atmospheric pressure, and is delivered to a mixing region located at the bottom of the hole from an outlet of the first conduit at a first pre-determined pressure. The wetted solids are delivered to an inlet of a second conduit at atmospheric pressure, and are delivered to the mixing region from an outlet of the second conduit at the first pre-determined pressure. The slurry produced in the mixing region is delivered to an inlet of a third conduit at the first pre-determined pressure, and is discharged from the outlet of the third conduit at a second pre-determined pressure.

According to another aspect of the invention, the fluid comprises compressed air and a form agent. Alternately, the fluid can comprise any suitable gas, or water or any suitable liquid, or any combination of gas and liquid.

According to another aspect of the present invention, the wetted solids comprises coal and water. Alternately, the wetted solids may comprise solid water materials and water, or any suitable dry, moist, wetted or slurried materials.

The present invention may advantageously be used in coarse particle slurry transportation pipeline systems, in well fracing systems, in solid tailings disposal systems, and in pulverized coal systems.

BRIEF DESCRIPTION OF THE DRAWINGS

The invention will further be described by reference to the accompanying drawings which illustrate particular embodiments of solids mixing well structure in accordance with the present invention, wherein like members bear like reference numerals and wherein.

DESCRIPTION OF THE PREFERRED EMBODIMENTS

Figure 1:
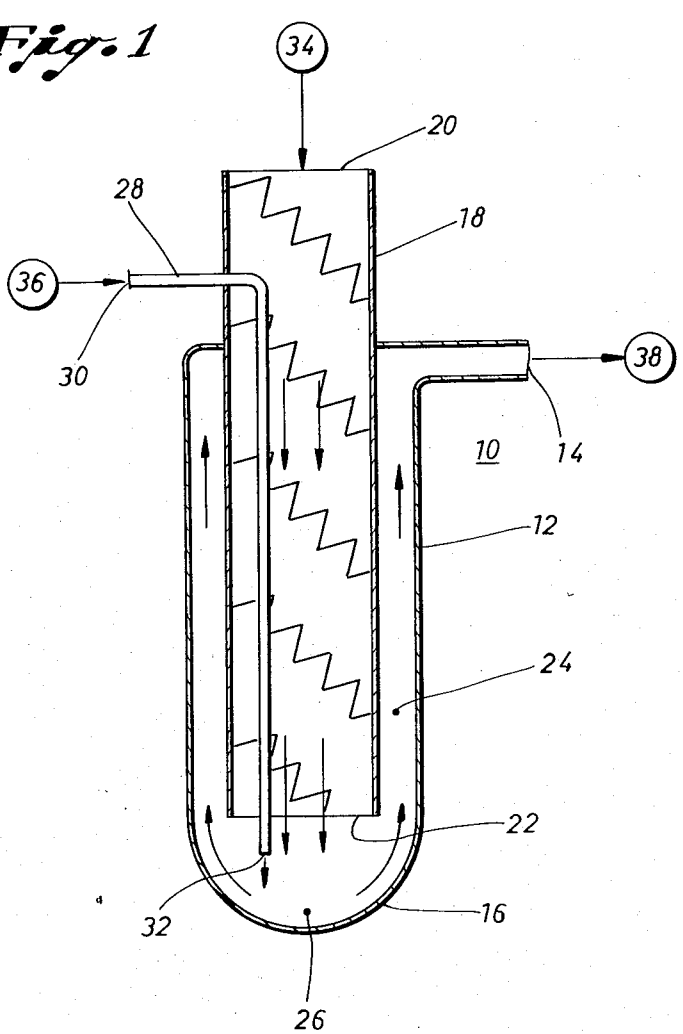
FIG. 1 is a schematic diagram of solids mixing well structure in accordance with the present invention.

Referring now to the drawings, and in particular to FIG. 1, there is shown a schematic representation of a solids mixing well 10 according to the present invention. The solids mixing well 10 includes a vessel 12 having a discharge port 14 and a bottom 16. The vessel 12 is substantially cylindrical and is disposed in an essentially vertical position.

A hollow cylindrical column 18 having an upper end 20 and a lower end 22 is positioned in the vessel 12 to form an annular region 24 between the outer surface of the cylindrical column 18 and the inner surface of the vessel 12. The lower end 22 is spaced from the bottom 16 of the vessel 12, the region between the lower end 22 and the bottom 16 being termed the mixing region 26.

The solids mixing well 10 further includes a conduit 28 having an inlet 30, and an outlet 32 located in the mixing region 26.

In operation, dry, moist, slurried or wetted solids 34 having a high specific gravity are introduced into the upper end 20 of the hollow cylindric column 18. The wetted solids 34 are introduced at the upper end 20 at atmospheric pressure and form a column of materials in the column 18. Due to the height of the column of materials in the cylindrical column 18, the wetted solids 34 are discharged from the lower end 22 of the cylindrical column 18 into the mixing region 26 at a first pre-determined pressure.

A fluid 36 having a lower specific gravity enters the inlet 30 of the conduit 28 at a pressure greater than atmospheric pressure. The fluid 36 discharges into the mixing region 26 from the outlet 32 of the conduit 28 at substantially the first pre-determined pressure. Thus, the wetted solids 34 and the fluid 36 each have substantially the same pressure when they enter the mixing region 26. They therefore readily mix with each other producing a slurry having a specific gravity between the higher specific gravity of the wetted solids and the lower specific gravity of the pumped fluid.

The head of the column of wetted solids and the head of the column of fluid are each substantially equal to each other, and are each greater than the head of the resulting slurry. Consequently, the slurry flows upward through the annular region 24 and out the discharge port 14. The slurry 38 is discharged through the port 14 at a second pre-determined pressure greater than atmospheric pressure.

In a specific example utilizing the apparatus illustrated in FIG. 1, coal is to be transported by pipeline in a foam/coal mixture. The wetted solids 34 entering the upper end 20 of the cylindrical column 18 consists of coal entering a rate of 10 tons per hour or approximately 333 pounds per minute, and water entering at 120 gallons per hour or approximately 17 pounds per minute. Thus total of 350 pounds per minute or 5.6 CFM (cubic feet per minute) of wetted solids enter the upper end 20.

The distance between the upper end 20 and the lower end 22 of the cylindrical column 18 in this example is 231 feet. The wetted solids consist of 95% coal and 5% water and its specific gravity is approximately 1.0. Consequently, the pressure at which the wetted solids are discharged into the mixing region 26 from the lower end 22 is 100 psi (pounds per square inch guage).

The fluid 36 fed into the inlet 30 of the conduit 28 consists of any suitable foam agent and air pressurized to 100 psi. The volume of fluid entering the inlet 30 is 210 SCFM (standard cubic feet per minute). The fluid is discharged into the mixing region 26 from the outlet 32 at a pressure of 100 psi and a rate of 30 CFM.

In the mixing region 26, the coal/water wetted solids enter at a rate of 5.6 CFM, and the air/foam fluid enters at a rate of 30 CFM. The specific gravity of the resulting slurry is approximately 0.16. The discharge port 14 is spaced 216 feet above the bottom 16 of the vessel 12. Thus, the column pressure consumption for the foam/coal slurry in the annular region 24 is approximately 16 psi. Since both the wetted solids and the fluid enter the mixing region with a pressure of 100 psi, and the slurry column has a pressure consumption of 16 psi, the resultant pressure with which the slurry 38 exits the discharge port 14 is 84 psi, the difference between 100 psi and 16 psi. Thus a coal/foam mixture is delivered at a pressure of 84 psi at the surface of a 231 feet deep solids mixing well using a 100 psi compressed air source. (As will be apparent to those skilled in the art, the calculations herein are approximations which assume no frictional losses in the system).

In a second specific example utilizing the apparatus illustrated in FIG. 1, a well 1000 feet deep, using a 500 psi compressed air source, produces a coal/foam mixture at the surface having a pressure of 420 psi.

In each example, ideally the water and coal mixture flows down the cylindrical column 18 with homogenous consistency. In non-ideal situations, the water contained in a particular volume of wetted solids may flow down the column 18 at a faster rate than the coal, lightening the column of wetted solids, or diluting the foam or slurry column produced in the mixing region 26, or both. Alternately, the coal which is included in a particular volume of wetted solids may flow down the cylindrical column 18 faster than the water, increasing the weight of the column of wetted solids contained in the cylindrical column 18, or thickening the slurry or foam produced in the mixing region 26 or both. To compensate for such non-ideal conditions, the apparatus of FIG. 1 is modified as illustrated in FIG. 2.

Figure 2:
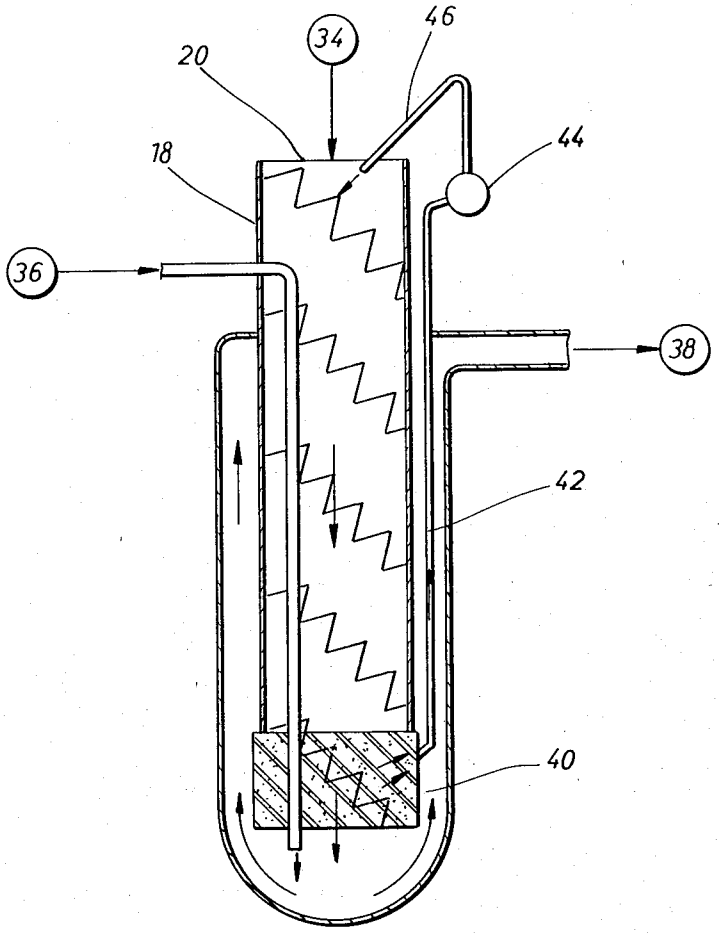
FIG. 2 is a schematic diagram illustrating a variant of the structure illustrated in FIG. 1 and having a fluid return conduit.

Referring now to FIG. 2, an alternate embodiment is illustrated having a filter member 40, a fluid return conduit 42, a pump member 44, and a fluid discharge conduit 46.

The filter member 40 is disposed at the peripheral surface of the cylindrical column 18 proximate the lower end 22. The filter member 40 may have any suitable structure such as a mesh, slots, holes and so forth.

The filter member 40 extracts a portion of the water contained in the wetted solids 34, directs that portion of water through the conduit 42 to the pump 44, through the conduit 46, and discharges that portion of water into the upper end 20 of the cylindrical column 18. The filter member 40 extracts a pre-determined amount of water which is then pumped back to the upper end 20.

In operation, the amount of water to be extracted from the wetted solids by the filter member 40 is determined by any suitable processing circuit which monitors the water flow rate, the solids content of the slurry, or any other suitable parameter. In an alternate embodiment (not illustrated), the pump member 44 is eliminated and the water extracted by the filter member 40 flows by artesian effect up through the conduits 42 and 46.

Figure 3:
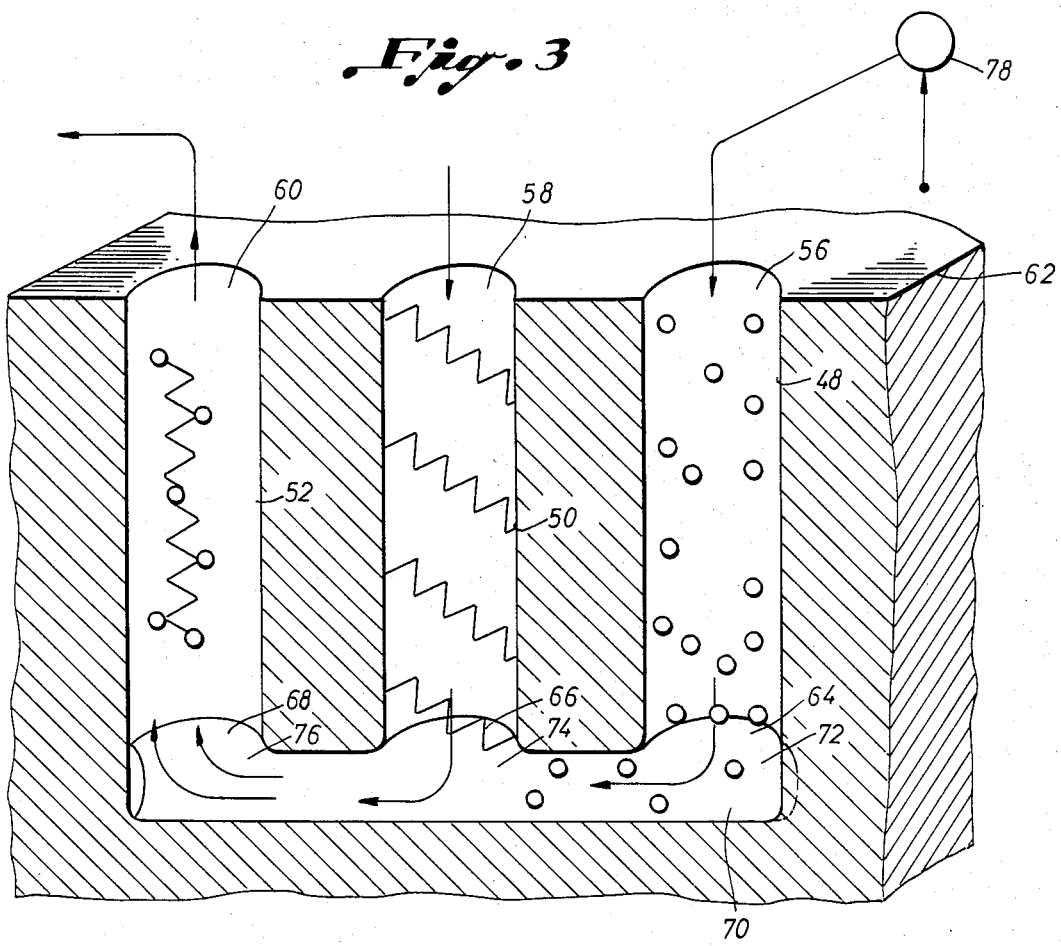
FIG. 3 is a cross-section view of a solids mixing well according to the present invention in which three cylindrical conduits are arranged in a linear fashion.

FIG. 3 illustrates an underground system suitable for transporting solid waste material. Referring to FIG. 3, hollow cylindrical columns 48, 50 and 52 are vertically disposed in the ground. The columns 48, 50, 52 have upper ends 56, 58, 60 level with the surface of the ground 62, and lower ends 64, 66, 68 disposed a pre-determined distance below the surface of the ground 62. A connecting structure 70 includes an inlet 72 connected to the lower end 64 of column 48, and inlet 74 connected to the lower end 66 of the column 50, and an outlet 76 connected to the lower end 68 of the column 52.

In a third specific example utilizing the apparatus illustrated in FIG. 3, the distance between the upper and lower ends of each column, for example, the distance between the upper end 56 and the lower end 64 of the column 48, is 200 feet. In this example, solid waste material having a specific gravity of 2.0 is to be transported with water having a specific gravity of 1.0 as a mixture of 50% by weight solids having a specific gravity 1.33. Water is pumped into the column 48 by a pump member 78. The pump 78 has a pump head of 200 feet (approximately 87 psi), and the water filled column 48 has a head of 200 feet (approximately 87 psi), for a total water head of 400 feet (approximately 174 psi) at the lower end 64 where the water enters the inlet 72 of the connecting structure 70.

The solid waste material enters the upper end 58 of the cylindrical column 50 at atmospheric pressure. The solids column in the cylindrical column 50 has a 200 foot head (approximately 174 psi) at the point where the solid waste material enters the inlets 74 of the connecting structure 70.

The water entering inlet 72 and the solids entering inlet 74 each have essentially the same pressure (approximately 174 psi) and readily mix in the connecting structure 70. The resulting mixture is 50% by weight solids and has a specific gravity of 1.33. The mixture discharged from the outlet 76 is at a pressure of approximately 174 psi and due to its specific gravity, has a head of 301 feet. The mixture flows up through the hollow cyclindrical column 52 and consumes approximately 116 psi while rising the 200 feet to the upper end 60 of the column 52. Upon reaching the surface of the ground 62, the mixture has a remaining head of 101 feet (approximately 58 psi).

The resulting pressure of 58 psi is lower than the original 87 psi pressure imparted to the water by the pump 78. This pressure is due to entrainment of static waste particles. The exit pressure of 58 psi, however, is the same procedure that would have been imparted if the solids and water had been mixed and then pumped by a pump (not illustrated) having a horsepower equal to that of the pump 78.

In a fourth specific example, the distance between the upper and lower ends of each of the hollow cylindrical columns is 1000 feet rather than 200 feet; the pump 78 introduces water into the upper end 56 of the column 48 at a pressure of 433 psi, producing 1000 feet of water head; and the mixture of 50% by weight solids exits the upper end 60 of the column 52 with a pressure of approximately 290 psi.

In the embodiment illustrated in FIG. 3, the hollow cylindrical columns 48, 50 and 52 are essentially laid out in a linear manner. Other embodiments are possible, a most advantageous embodiment being illustrated in FIG. 4.

Figure 4:
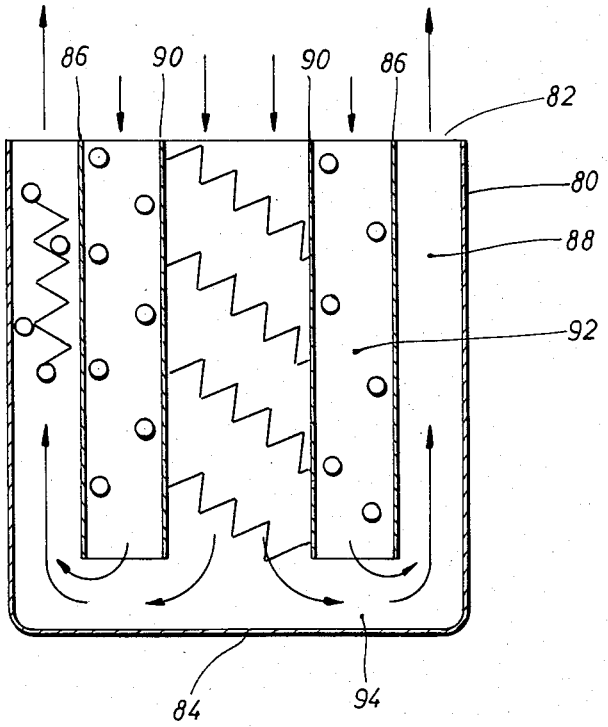
FIG. 4 is a cross-section view of a solids mixing well according to the present invention in which three conduits are arranged in a coaxial fashion.

Referring now to FIG. 4, a coaxially disposed mixing well structure is illustrated. An outer cylindrical structure 80 is open at an upper end 82 and closed at a lower end 84.

An intermediate cylindrical structure 86, open at both its upper and lower ends, is disposed coaxially within the outer cylindrical structure 80 to form an annular region 88 between the outer surface of the intermediate cylindrical structure 86 and the inner surface of the outer cylindrical structure 80.

An inner cylindrical structure 90, open at its upper and lower ends, is coaxially disposed within the intermediate cylindrical structure 86 to form an annular region 92 between the outer surface of the inner cylindrical structure 90 and the inner surface of the intermediate cylindrical structure 86.

The inner cylindrical structure 90 and the intermediate cylindrical structure 86 are each essentially the same height, and each have a height less than the distance between the lower end 84 and the upper end 82 of the outer cylindrical structure 80. Consequently, a mixing region 94 is formed in the lower region of the outer cylindrical structure 80, proximate the lower ends of the intermediate cylindrical structure 86 and the inner cylindrical structure 90 and the lower end 84 of the outer cylindrical structure 80.

In operation, wetted solids are introduced at atmospheric pressure into the upper end of the inner cylindrical structure 90; fluid is introduced at a pressure greater than atmospheric pressure into the upper end of the annular region 92; and the wetted solids and fluid are discharged at substantially the same pressure into the mixing region 94 where they mix with each other. The resulting slurry flows up through the annular region 88 and is discharged at the upper end of the annular region 88 at a pressure greater than atmospheric pressure.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A method for adding in a mixing structure having a mixing region a second material at atmospheric pressure to a relatively high-pressure stream of a first material, said first material having a first specific gravity and being delivered to said mixing region through a first conduit, and said second material having a second specific gravity and being delivered to said mixing region through a second conduit, said first and second materials being mixed to produce a third material having an intermediate pressure and an intermediate specific gravity, said method comprising the steps of:

delivery said first material to said mixing region at a first pre-determined pressure;

delivering said second material to said mixing region at said first pre-determined pressure; and discharging said third material from said mixing structure at a second pre-determined pressure greater than atmospheric pressure.

2. The method according to claim 1 wherein said step of delivering said first material further comprises:

delivering said first material at a pressure greater than atmospheric pressure to the inlet of said first conduit; and discharging said first material from the outlet of said first conduit at said first pre-determined pressure.

3. The method according to claim 2 wherein said step of delivering said second material further comprises:

delivering said second material at atmospheric pressure to the inlet of said second conduit; and discharging said second material from the outlet of said second conduit at said first pre-determined pressure.

4. The method of claim 3 wherein said step of discharging said third material further comprises:

delivering from said mixing region to the inlet of a third conduit said third material at said first pre-determined pressure; and discharging from the outlet of said third conduit said third material at said second pre-determined pressure.

* * * * *

UNITED STATES PATENT AND TRADEMARK OFFICE

CERTIFICATE OF CORRECTION

PATENT NO. : 4,505,591

DATED : March 19, 1985

INVENTOR(S) : Roger W. Day and Charles N. Grichar

It is certified that error appears in the above-identified patent and that said Letters Patent is hereby corrected as shown below:

In the statement of Assignee [73], that portion reading "Geosource Inc., Houston, Texas" should read -- Geolograph/Pioneer Inc.

At column 2, line 26, "fluid comprises compressed air and a form agent" should read -- fluid comprises compressed air and a foam agent --.

At column 3, line 42, "coal entering a rate of 10 tons per hour or approximately" should read -- coal entering at a rate of 10 tons per hour or approximately --.

At column 3, line 45, "Thus total of 350 pounds per minute or", should read -- Thus a total of 350 pounds per minute or --.

At column 3, line 54, "(pounds per square inch guage)" should read -- (pounds per square inch gauge) --.

UNITED STATES PATENT AND TRADEMARK OFFICE

CERTIFICATE OF CORRECTION

PATENT NO. : 4,505,591

DATED : March 19, 1985

INVENTOR(S) : Roger W. Day and Charles N. Grichar

It is certified that error appears in the above-identified patent and that said Letters Patent is hereby corrected as shown below:

At column 5, line 34, "This pressure is due" should read -- This pressure loss is due --.

Column 5, line 36, "the same procedure" should read -- the same pressure --.

Signed and Sealed this

*Sixth* Day of *May 1986*

[SEAL]

*Attest:*

DONALD J. QUIGG

*Attesting Officer*

*Commissioner of Patents and Trademarks*